US010058190B1

(12) United States Patent
Blazar et al.

(10) Patent No.: US 10,058,190 B1
(45) Date of Patent: Aug. 28, 2018

(54) AIR-FOAM MATTRESS COMPONENT

(71) Applicant: Jiajing USA, Inc., Richmond (CA)

(72) Inventors: Joseph E. Blazar, Owensboro, KY (US); Gary M. Wahrmund, Fort Worth, TX (US)

(73) Assignee: Jiajing USA, Inc., Richmond, BC (CA)

( * ) Notice: Subject to any disclaimer, the term of this patent is extended or adjusted under 35 U.S.C. 154(b) by 321 days.

(21) Appl. No.: 14/097,604

(22) Filed: Dec. 5, 2013

Related U.S. Application Data

(60) Provisional application No. 61/733,794, filed on Dec. 5, 2012.

(51) Int. Cl.
*A47C 27/14* (2006.01)
*A47C 27/18* (2006.01)
*A47C 27/10* (2006.01)

(52) U.S. Cl.
CPC ..... *A47C 27/18* (2013.01); *A47C 27/10* (2013.01)

(58) Field of Classification Search
CPC ..... A47C 27/088; A47C 27/18; A47C 27/084; A47C 27/10
USPC ..... 5/709, 706, 710
See application file for complete search history.

(56) References Cited

U.S. PATENT DOCUMENTS

| | | | | |
|---|---|---|---|---|
| 265,615 | A | 10/1882 | Laskey | |
| 509,081 | A | 11/1893 | Harding | |
| 609,819 | A | 8/1898 | Lawrence | |
| 613,328 | A | 11/1898 | Shyrock | |
| 722,135 | A | 3/1903 | Nunan | |
| 1,262,510 | A | 4/1918 | Kelly | |
| 2,068,134 | A | 1/1937 | Houghton | |
| 2,826,767 | A | 3/1958 | Edwards | |
| 2,886,834 | A | 5/1959 | Gilbertson | |
| 2,942,281 | A | 6/1960 | Cole | |
| 3,058,122 | A | 10/1962 | McDaniel et al. | |
| 3,118,153 | A | 1/1964 | Hood | |
| 3,867,732 | A | 2/1975 | Morrell | |
| 3,872,525 | A | 3/1975 | Lea et al. | |
| 3,943,583 | A | 3/1976 | Ishikawa | |
| 4,025,974 | A * | 5/1977 | Lea et al. | 5/709 |
| 4,190,286 | A | 2/1980 | Bentley | |
| 4,267,611 | A | 5/1981 | Agulnick | |
| 4,528,705 | A | 7/1985 | Greenawalt | |

(Continued)

FOREIGN PATENT DOCUMENTS

| | | |
|---|---|---|
| WO | WO 2013139857 A1 | 9/2013 |
| WO | WO 2013152404 A1 | 10/2013 |

OTHER PUBLICATIONS

Screen capture of Petersens Hunting Guide 2012.*

(Continued)

*Primary Examiner* — Richard G Davis
(74) *Attorney, Agent, or Firm* — Wick Phillips Gould & Martin, LLP

(57) ABSTRACT

Disclosed embodiments may relate to mattresses and/or mattress components having one or more foam-filled air chambers within an air impermeable cover. Typically, the foam core within an air chamber would comprise open cell foam, but the air chamber would not be self-inflating. Rather, a pump might be used to adjust the firmness and/or comfort of the mattress, inflating and deflating the air chamber according to user's preference. Embodiments might also fuse or bond at least the top surface of the impermeable cover to the foam core(s).

22 Claims, 7 Drawing Sheets

(56) References Cited

U.S. PATENT DOCUMENTS 4,624,877 A 11/1986 Lea et al.
4,707,027 A 11/1987 Horvath et al.
4,788,729 A 12/1988 Walker
4,807,313 A 2/1989 Ryder et al.
4,821,348 A 4/1989 Pauna
4,914,766 A 4/1990 Moore
4,953,247 A 9/1990 Hasty
4,995,124 A 2/1991 Wridge, Jr. et al.
5,023,967 A 6/1991 Ferrand
5,033,133 A 7/1991 Nissen
5,060,325 A 10/1991 Carnahan et al.
5,077,845 A 1/1992 Tokunaga et al.
5,090,077 A 2/1992 Caden et al.
5,138,729 A 8/1992 Ferrand
5,152,018 A 10/1992 Lea
5,185,897 A 2/1993 Van Laanen
5,231,720 A 8/1993 Benoff
5,249,318 A 10/1993 Loadsman
5,267,363 A 12/1993 Chaffee
5,282,286 A 2/1994 MacLeish
5,287,577 A 2/1994 Bremer et al.
5,345,629 A 9/1994 Ferrand
5,367,726 A 11/1994 Chaffee
5,419,347 A 5/1995 Carruth
5,421,044 A 6/1995 Steensen
5,452,487 A 9/1995 Leggett
5,491,854 A 2/1996 Music
5,542,136 A 8/1996 Tappel
5,588,168 A 12/1996 Byrne et al.
5,634,225 A 6/1997 Miller, Sr. et al.
5,647,079 A 7/1997 Hakamiun et al.
5,689,844 A 11/1997 Liu
5,702,536 A 12/1997 Carruth
5,705,252 A 1/1998 Lea et al.
5,745,941 A 5/1998 Miller, Sr.
5,802,640 A 9/1998 Ferrand et al.
5,904,172 A 5/1999 Gifft et al.
5,991,949 A 11/1999 Miller, Sr. et al.
6,003,745 A 12/1999 Mechanic
6,012,188 A 1/2000 Daniels et al.
6,014,783 A 1/2000 Collier et al.
6,016,582 A 1/2000 Larson
6,038,722 A 3/2000 Giori et al.
6,108,835 A 8/2000 Hwang
6,108,844 A 8/2000 Kraft et al.
6,119,292 A 9/2000 Haas
6,151,735 A 11/2000 Koby et al.
6,161,231 A 12/2000 Kraft et al.
6,219,868 B1 4/2001 Wang
6,269,505 B1 * 8/2001 Wilkinson ..... 5/713
6,317,908 B1 11/2001 Walpin
6,397,419 B1 6/2002 Mechache
6,401,279 B1 6/2002 Vaughn
6,446,289 B1 9/2002 Su et al.
6,481,033 B2 * 11/2002 Fogel ..... 5/727
6,483,264 B1 11/2002 Shafer et al.
6,487,739 B1 12/2002 Harker
6,505,368 B1 1/2003 Ellis et al.
6,592,184 B1 7/2003 Segal et al.
6,651,277 B1 11/2003 Marson
6,658,827 B2 12/2003 Brownlie
6,668,408 B2 12/2003 Ferrand et al.
6,684,433 B2 2/2004 Giori et al.
6,684,434 B2 2/2004 Ellis et al.
6,687,937 B2 2/2004 Harker
6,691,348 B2 2/2004 Plummer et al.
6,721,980 B1 4/2004 Price et al.
6,725,485 B2 4/2004 Hayes
6,745,420 B2 6/2004 Giori et al.
6,771,190 B2 8/2004 Gordon
6,826,795 B2 12/2004 Wilkinson
6,912,748 B2 7/2005 VanSickle
6,922,863 B2 * 8/2005 Giori et al. ..... 5/709
6,951,038 B1 10/2005 Ganoe, Sr.
6,988,286 B2 1/2006 Schecter et al.
7,051,389 B2 5/2006 Wassilefsky
7,086,104 B1 8/2006 Tsay
RE39,408 E 11/2006 Wang
7,141,131 B2 11/2006 Foxen et al.
7,328,472 B2 2/2008 Chaffee
7,415,742 B2 8/2008 Wassilefsky
7,475,440 B2 1/2009 Chaffee
7,480,952 B2 1/2009 Nickerson et al.
7,506,390 B2 3/2009 Dixon et al.
7,513,002 B2 4/2009 Best
7,530,127 B2 5/2009 Leifermann et al.
7,600,277 B2 10/2009 Heimbrock
7,698,765 B2 4/2010 Bobey et al.
7,735,169 B2 6/2010 Wassilefsky
7,761,945 B2 7/2010 Butler
7,849,544 B2 12/2010 Flocard et al.
7,886,386 B2 * 2/2011 Balonick et al. ..... 5/709
8,037,564 B2 10/2011 Satoh et al.
8,104,126 B2 1/2012 Caminade et al.
8,108,957 B2 2/2012 Richards et al.
8,122,545 B2 * 2/2012 Wilkinson ..... 5/713
8,146,191 B2 4/2012 Bobey et al.
8,205,282 B2 6/2012 Brogan et al.
8,510,884 B2 8/2013 Lee
2002/0116766 A1 8/2002 Stolpmann
2002/0124319 A1 9/2002 Giori et al.
2002/0133879 A1 9/2002 Smith et al.
2002/0138911 A1 10/2002 Giori et al.
2003/0009830 A1 * 1/2003 Giori et al. ..... 5/709
2003/0009831 A1 1/2003 Giori et al.
2003/0163874 A1 9/2003 Boso et al.
2003/0217414 A1 11/2003 Marson
2003/0229943 A1 12/2003 Lewis
2004/0000011 A1 1/2004 Hsu
2004/0163178 A1 8/2004 Corneil
2004/0168256 A1 9/2004 Chaffee
2005/0125905 A1 6/2005 Wilkinson
2005/0172412 A1 8/2005 Pearson
2005/0257320 A1 11/2005 Mollett
2005/0278852 A1 12/2005 Wahrmund et al.
2006/0005314 A1 1/2006 Lee
2006/0031996 A1 2/2006 Rawls-Meehan
2006/0040803 A1 2/2006 Perez, Jr.
2006/0064819 A1 3/2006 Mollett
2006/0075569 A1 * 4/2006 Giori et al. ..... 5/709
2006/0101743 A1 * 5/2006 Nickerson et al. ..... 52/235
2006/0162779 A1 7/2006 Chaffee
2006/0179577 A1 8/2006 Chaffee
2006/0253993 A1 11/2006 Lau
2007/0056111 A1 3/2007 Lastman
2007/0251165 A1 11/2007 Kern et al.
2008/0028534 A1 2/2008 Wilkinson
2008/0060138 A1 3/2008 Price et al.
2008/0235877 A1 10/2008 Murray et al.
2008/0263772 A1 10/2008 Chiu
2009/0032126 A1 2/2009 Kissel, Jr.
2009/0070941 A1 3/2009 Lau
2009/0235460 A1 9/2009 Hitch et al.
2009/0300846 A1 12/2009 Chaffee
2010/0071135 A1 3/2010 Hsu
2010/0089458 A1 4/2010 Chaffee
2010/0125951 A1 5/2010 Stefano et al.
2010/0180384 A1 7/2010 Balonick et al.
2010/0199434 A1 8/2010 Keesaer et al.
2012/0011656 A1 1/2012 Daly
2012/0011657 A1 1/2012 Kovacs et al.
2012/0036642 A1 2/2012 Brogan et al.
2012/0090698 A1 4/2012 Giori et al.
2013/0000048 A1 1/2013 Lipman et al.
2013/0019409 A1 1/2013 Blazar et al.
2014/0082846 A1 3/2014 Blazar

OTHER PUBLICATIONS

Screen capture of internet archive of Petersens Hunting Guide 2012.*

(56) References Cited

OTHER PUBLICATIONS

Screen capture of Wayback Machine archive of http://en.wikipedia.org/wiki/Therm-a-Rest.*

* cited by examiner

AIR-FOAM MATTRESS COMPONENT

CROSS-REFERENCE TO RELATED APPLICATIONS

This application is related as a non-provisional of and claims benefit under 35 U.S.C. § 119 to U.S. Provisional Patent Application Ser. No. 61/733,794 entitled "Air-Foam Mattress Component" and filed Dec. 5, 2012, which is assigned to the Assignee of the present application and hereby incorporated by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Air mattresses, of the sort sold as Sleep Number™ beds, have been commonly available in the marketplace and are well-known. These types of mattresses typically are adjustable, so that the amount of air pumped into the mattress air chamber can alter the firmness, support, cushioning, comfort, etc. provided by the mattress (for example, allowing a user to customize the mattress based on personal preference). In some such mattresses (for example, typically for larger mattresses such as full, queen, and/or king sizes), the characteristics of the mattress may be altered independently for the two sides of the bed. This may allow two users sleeping on the same bed to customize their side for their specific preference. While these current air mattresses have proven far superior to camping-style inflatable mattresses for comfort and extended use (allowing them to be used for long-term home use, for example), disclosed embodiments herein may offer the potential for even further improved performance in one or more areas.

SUMMARY

Aspects of the disclosure may include embodiments of a mattress comprising one or more of the following: an open-celled foam core; and an impermeable cover enclosing the foam core; wherein the impermeable cover may comprise an air inlet valve (or other means of fluid communication, typically forming the sole fluid entry and/or exit port into the impermeable cover) and a top and/or bottom surface; and wherein the top and/or bottom surface of the impermeable cover may be joined (e.g. bonded (for example with adhesive) or fused (for example, by welding)) to an upper and/or lower (i.e. corresponding) surface of the foam core. In other aspects, disclosed mattress (or mattress component or cushioned support device) embodiments may comprise one or more of the following: two open cell foam cores; an air impermeable cover encasing both foam cores and having an air impermeable divider between the two foam cores forming two joined side-by-side foam-filled air chambers (with an airtight barrier/divider therebetween); and an air inlet valve (or other means of fluid communication through the impermeable cover) for each air chamber. Embodiments may form two independent foam-filled air chambers encased in one seamless impermeable cover/core, and for example the air chambers may not be in fluid communication with each other. In embodiments, the fluid/air pressure in each air chamber may be independently controlled via the air inlet valve, for example using a pump. In some embodiments, the impermeable cover may further comprise a top surface and a bottom surface; and the top and/or bottom surface of the impermeable cover may be fused/bonded to (a corresponding surface for) the two foam cores.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
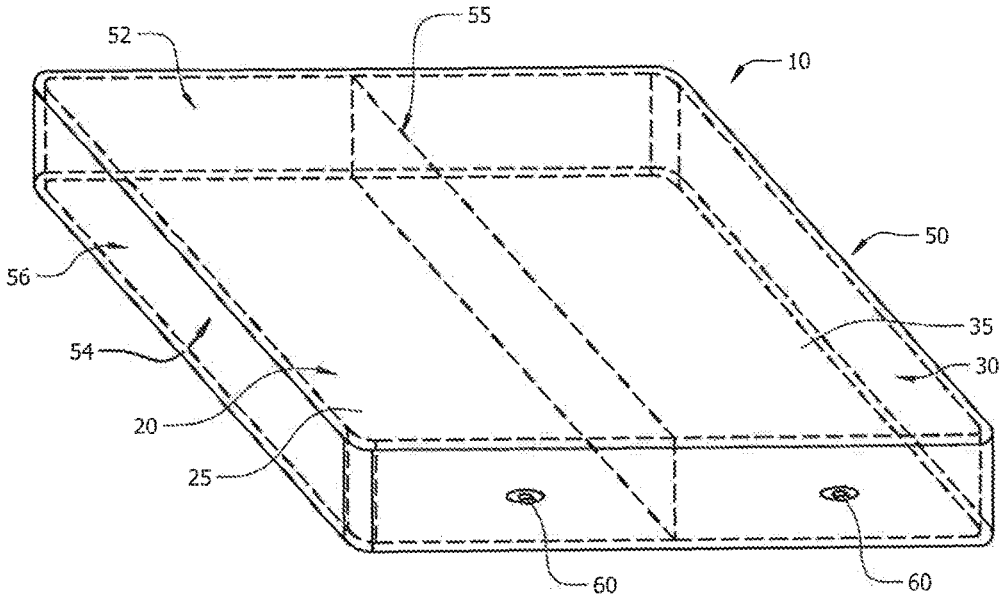
FIG. 1 illustrates a perspective view (with some interior features shown in dotted-lines) of an exemplary embodiment of a mattress component.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Disclosed embodiments typically may relate to a mattress (and/or a component in a mattress) comprising one or more of the following: an open-celled foam core; and an air impermeable cover enclosing the foam core; with the impermeable cover typically comprising an air inlet valve (or other means of fluid communication between the inner foam core and the external/ambient environment (for example via pump) outside the impermeable cover, typically forming the sole fluid entry and/or exit port into the impermeable cover). In embodiments, the impermeable cover may comprise a top and/or bottom surface (with the top surface typically serving as a sleep surface for a user of the mattress); and wherein the top and/or bottom surface of the impermeable cover may be bonded (for example, using adhesive) or fused (for example, welded using heat and/or sonic welding) to at least a portion of an upper/lower (i.e. corresponding) surface of the foam core. Bonding or fusing are exemplary means of joining/attaching a surface of the impermeable cover to the foam core, and other joining means might also be employed in other embodiments. While embodiments may typically weld substantially the entire top and/or bottom surface of the impermeable cover to the corresponding surface of the inner foam core, in other embodiments the top and/or bottom surface might only be welded to the foam core at strategic points (for example, spot welded periodically, with spacing sufficient to ensure that the top/bottom surface may typically move as an integrated unit whenever the foam core is compressed).

Typically, the impermeable cover of an embodiment may also comprise a plurality of (typically primarily vertical) side surfaces (for example four sides, relating to the head, foot, left, and right sides of the mattress). In embodiments, the side surfaces may not be bonded or fused (or otherwise joined) to the foam core, leaving an air space/gap/channel between the side surfaces and the foam core. Such an air space may serve as a conduit for more rapid distribution of air throughout the foam core of the mattress (for example, aiding distribution of air throughout the open cell foam structure). In other embodiments, however, the side surfaces may be partially and or substantially entirely bonded/fused (or otherwise joined) to the foam core.

In mattress embodiments, the foam core typically has an IFD (Identation Force Deflection), and the IFD of the foam core may be insufficient to self-inflate (fully) the mattress. Rather, the IFD of the air chamber(s) typically may be based on the IFD of the foam within a pressurized (typically above atmospheric pressure) chamber of air. For example, the foam core may comprise soft foam (for example having an IFD less than about 20 and/or between about 18-20 IFD), with an IFD in ambient atmosphere typically less than the minimum IFD for the air chamber (such that the range of available IFD for the air chamber(s) of the mattress might require pressurized air in the air chamber greater than ambient atmosphere). Of course, in other embodiments, the foam core might have a higher IFD, be self-inflating, and/or the air chamber(s) may not need to be inflated above ambient atmospheric conditions. The foam of the foam core typically may not be sufficiently supportive to serve as a sleeping surface alone (i.e. when it is not inflated with air within the impermeable cover), since the foam core typically should not restrict the range of adjustment of the support/comfort level of the mattress using an air pump. In other words, the mattress (and/or component) typically may be designed to allow for an IFD range based on the level of inflation (typically with air pressure greater than ambient atmosphere) within the impermeable cover, and the foam of the foam core typically should have an IFD less than the bottom of that range so that it will not unduly restrict the IFD range of the mattress. Typically, the foam core might comprise urethane foam. The impermeable cover of some embodiments typically might comprise woven polyester. And in embodiments, the impermeable cover may comprise a material operable to be fused to the urethane foam of the foam core (for example using sonic or heat welding).

In larger mattresses, for example queen and/or king sized mattresses, two separate foam cores might be used, for example to allow for independent adjustment of the support/comfort on different sides for different users. For example, in such embodiments a mattress might comprise one or more of the following: two open cell foam cores; an air impermeable cover encasing both foam cores and having an air impermeable divider between the two foam cores forming two joined side-by-side foam-filled air chambers (with an airtight barrier/divider therebetween); and an air inlet valve (or other means of fluid communication through the impermeable cover) for each air chamber. While it may be possible in some embodiments to have a separate impermeable cover for each foam core (and using a means for joining the two air chambers into an integral whole, for example using a zipper), it may be preferable to use a single impermeable cover for both foam cores in some embodiments. Typically, the use of two foam cores separated by an air impermeable divider might form two independent foam-filled air chambers encased in one seamless impermeable cover/core. Typically, such air chambers would not be in fluid communication with each other, so that for example the fluid/air pressure in each air chamber may be independently controlled via the air inlet valves (typically using one or more pumps). In other embodiments, however, it might be possible to allow for some fluid communication between the air chambers, in certain instances for example.

In embodiments, the impermeable cover may further comprise a top surface and a bottom surface; and the top and/or bottom surface of the impermeable cover may be fused/welded to (at least a portion of, for example spot fused or substantially entirely fused to, a corresponding surface for) the two foam cores. For example, the top surface of some embodiments might be fused to substantially the entire upper/corresponding surface of the two foam cores, while in other embodiments both the top and bottom surfaces might be fused to substantially the entire corresponding surface of the foam cores (with the top surface fused to the upper surfaces of the foam cores, and the bottom surface fused to the lower surface of the foam cores). Typically, the impermeable cover may further comprise a plurality of side surfaces; and the side surfaces typically might not be fused/welded to corresponding surfaces for the two foam cores (creating an air space/gap/channel on each side of the mattress between the impermeable cover and the foam cores). In other embodiments, however, the side surfaces of the impermeable cover may be completely or partially fused (or bonded) to the corresponding sides of the foam cores.

In embodiments, the foam of the foam cores (which typically would be the same type of foam for both cores) might have an IFD sufficiently low so as to not provide sufficient support for sleep without air pressure in the air chamber(s). For example, the IFD of the foam cores might be insufficient to effectively/fully self-inflate the air chambers (for example, above the minimum IFD range of the mattress and/or to the upper IFD range of the mattress) using only ambient air for example, such that the foam cores may only function effectively as a mattress component when used within an impermeable cover that is pressurized (for example, using a pump). Typically, the foam of the foam cores may comprise urethane foam. Furthermore, the impermeable cover may comprise woven polyester. In some embodiments, the impermeable cover may further comprise a backing material that may be welded (for example, using sonic or heat welding) to the urethane foam. Typically, the impermeable cover might have good elasticity, for example superior to that previously used in Sleep Number™ beds.

In some embodiments, each foam core may comprise at least two different foam elements. For example, each foam core might comprise a firmer foam about the perimeter of the air chamber surrounding a less firm foam (since the firmer perimeter foam might aid in handling edge collapse when, for example, a user is sitting on the edge of the mattress). Or in other embodiments, a firmer foam might be used for posturization (for example, to provide better support for a user's hips or lower back) near the center of the air chamber (along its length from head to foot), and then be surrounded by a softer foam. Other embodiments might include both firmer perimeter foam and firmer posturizing foam, with the remainder of the foam core being softer foam. Typically, even the firmer foam would still be insufficient to self-inflate the mattress.

In embodiments, the mattress might further comprise one or more comfort layers (of foam or other comfort material) atop the air chambers and/or a foam encasement about the exterior perimeter of the impermeable cover. Typically, a mattress might further comprise an outer cover (for example a ticking) encasing the other components. And typically, one or more (external) pumps would be in fluid communication (via one or more hoses, for example) with the air inlet valves of the air chambers of the mattress. The pump(s) might be used to control and/or alter the air pressure within the air chambers, thereby adjusting the IFD (firmness/comfort) level of the mattress. In some embodiments, the pump(s) might only be used to deflate the air chambers, allowing self-inflation properties of the foam cores to aid with inflation. In other embodiments, the pump(s) might be used for inflation, but the air chambers might be deflated using the weight of the user's body lying on the mattress (to force air out the air inlet valve, for example). Typically, however, the foam of the cores might be insufficient for effective self-inflation of the air chambers and/or the weight of the user(s) might be insufficient for effective deflation of the air chambers; rather, the pumps(s) might be used to control both inflation and deflation of the air chambers. In such embodiments, the purpose of the foam core may not be self-inflation, but rather to provide improved mattress characteristics in at least certain instances.

Typically, the impermeable cover might be formed by welding (using sonic or heat welding, for example) the top surface of the impermeable cover to the plurality of side surfaces of the impermeable cover, welding the bottom surface of the impermeable cover to the plurality of side surfaces of the impermeable cover, and/or welding each side surface to mating/adjacent side surfaces; thereby forming flap seal/seams (at interfaces) at fused/bonded overlap. And in embodiments having two separate air chambers, the impermeable cover might further be formed by welding a divider panel in place in the interior of the impermeable cover, for example splitting the interior of the impermeable chamber into two halves with side-by-side air chambers. In embodiments, the foam cores might be placed within the air chamber(s) of the impermeable cover prior to sealing of the impermeable cover (for example, before the top surface is welded in place). Air inlet valves might also be attached to the air chamber(s), providing communication into and/or out of the air chamber(s) (for example, placed in cut-outs in a side wall of the air chamber(s) and welded or bonded with adhesive into place). Typically, the IFD of each air chamber of the mattress might be provided (at least in part) based on the innate IFD of the foam in combination with the amount of air pressure within each air chamber, ranging based on the amount of air pressure (typically above ambient atmospheric conditions) in the air chamber for example. Thus, the pump(s) might be used to control/alter the IFD of the mattress based on a user's preference.

In other embodiments, a mattress might comprise: an open-celled foam core; and an impermeable cover enclosing the foam core; with the impermeable cover comprising a means of fluid communication with an external pump, and a top surface; and wherein the top surface of the impermeable cover may be joined (for example, fused or bonded) to at least a portion of a corresponding surface of the foam core. Typically, the enclosure of the foam core within the impermeable cover might form a foam-filled air chamber, with the IFD of the air chamber being adjustable based on the amount of air within the air chamber (so for example, the external pump might be used to alter the IFD of the air chamber, and thus the mattress). In typical embodiments, the IFD of the foam core may be less than the minimum limit of the IFD range of the mattress air chamber, such that the foam core (and/or foam-filled air chamber) would not typically be self-inflating. The following specific examples of embodiments, discussed with respect to the drawing figures, might be useful in furthering the understanding of persons skilled in the art field.

Turning now to FIG. 1, an embodiment of a mattress 10 (or mattress component) comprising an air impermeable cover 50 and two open-cell foam cores 25 and 35 (arranged in side-by-side configuration within the impermeable cover encasing them (and in the embodiment of FIG. 1, having an air-impermeable divider 55 located between the foam cores, forming two independent air chambers 20 and 30)) is shown. The impermeable cover 50 of FIG. 1 may comprise a top surface 52 and a bottom surface 54, and typically may also comprise a plurality of side surface 56 therebetween (typically extending substantially vertically from the top surface to the bottom surface to form an enclosed box-like structure). The impermeable cover 50 typically may be formed of material that is substantially air impermeable. And in the embodiment of FIG. 1, an air-impermeable divider 55 typically may extend lengthwise (approximately down the centerline of the mattress) between the two foam cores 25 and 35, forming two air chambers 20 and 30 within the impermeable cover 50 that are not in fluid communication with each other. In the embodiment of FIG. 1, each air chamber has an air inlet valve 60 (operable to allow air to enter and/or exit the corresponding air chamber). Typically, the air inlet valve 60 of each air chamber may be secured within a side wall of the impermeable cover 50, so that fluid communication between the interior of each air chamber and the exterior/ambient surrounding environment (or in the embodiment of FIG. 1 more typically an external pump) may typically occur exclusively through the air inlet valves 60 (since the impermeable cover in FIG. 1 typically might not include other ports and is generally impermeable to air and/or other fluids).

The foam cores 25, 35 of FIG. 1 typically may be formed of open-cell foam. The open cell foam cores within an impermeable cover 50 may allow for regulation of the firmness/comfort cushioning (for example, the IFD) of the air chambers 20, 30 based on the air pressure within the chambers (with the air in the impermeable cover typically filling the open cell structure of the foam cores and interacting to determine the IFD of the air chambers). In the embodiment of FIG. 1, the foam cores typically are formed of urethane foam. The foam of FIG. 1 typically may have an IFD that is too soft to self-inflate (fully) the air chamber and/or to provide a comfortable sleep surface. Typically, the IFD of the foam of the foam cores in ambient air conditions may be too soft to provide the minimum IFD of the available ranges for the mattress air chambers. For example, the IFD of the foam cores of FIG. 1 may be less than the lower end of the available IFD range of the air chambers (which may be based on providing a certain amount of air pressure within the foam-filled air chambers). Thus, the foam cores of FIG. 1 would not typically even provide the minimum IFD for the air chambers, and could not self-inflate the air chambers to the minimum and/or maximum IFD without (pressurized) air pressure (typically above that of the ambient environment).

Clearly, the foam within the air chambers of FIG. 1 is not intended to provide self-inflation characteristics to the mattress. Rather, the inclusion of foam within the air chambers of FIG. 1 may aid mattress performance. For example, having foam in the air chambers may reduce the amount of collapse that the mattress may experience when a user sits on an edge of the bed (i.e. side collapse), by providing some support even when the weight of the user might force air away from a particular area (for example, when the air pressure in the air chamber is low and/or air is displaced from one side of the air chamber). Additionally, the foam-filled air chambers may reduce bottoming-out concerns (by providing a minimum amount of support even when air in the chamber is displaced and/or when air pressure in the chamber is low). Foam-filled air chambers may offer better lower back and/or hip support, by reducing the amount of sag (since, for example, the foam may provide some supplemental support to areas in which air is displaced). And by including foam in the air chambers, it may be unnecessary to provide a supporting foam rail down the longitudinal centerline of the mattress, between the air chambers (as is often required for standard non-foam air mattresses). Thus, including foam in the air chambers may address rolling issues arising from having a foam rail or other support element between the air chambers.

In the embodiment of FIG. 1, the top surface 52 of the impermeable cover typically might be fused (for example welded) to the corresponding (so in this case, upper) surface of the foam cores 25, 35. While some embodiments might only spot weld the top surface 52 to the foam cores, in FIG. 1 the top surface 52 may be welded (for example sonic welded) to substantially the entire upper surface of the foam cores 25, 35 (so that the top surface and the foam cores might be fused across substantially the entire interface between the top surface and the foam cores). By fusing the top surface 52 to the foam cores 25, 35, any ballooning effect and/or motion transfer issues should be minimized. For example, the fusing may allow the entire top surface and/or air chamber(s) to function as an integrated unit when under compression. This may result in a completely flat top surface and/or minimize rolling effect that may be problematic in standard air mattresses. The flat top surface may reduce pressure points experienced by a user, especially in instances when the material of the impermeable cover has increased elasticity. Additionally, fusing the top surface of the impermeable cover to the two foam cores may help minimize the feel of the boundary between the two foam cores (for example, smoothing the transition from one foam core to the other by spanning both with a single, integrated surface). So in the embodiment of FIG. 1, the foam core(s) typically may not serve self-inflation purposes (since for example, the IFD of the foam is typically insufficient for self-inflation), but may instead improve the characteristics of the mattress and how it behaves when compressed (for example, when a user lies atop it or sits on the edge). And in FIG. 1, the use of foam-filled air chamber(s) in combination with fusing the top surface of the impermeable cover to the foam core(s) may further improve the comfort and feel of the mattress (and may address one or more of the typical concerns that may arise for more conventional air-only chamber devices).

Figure 2:
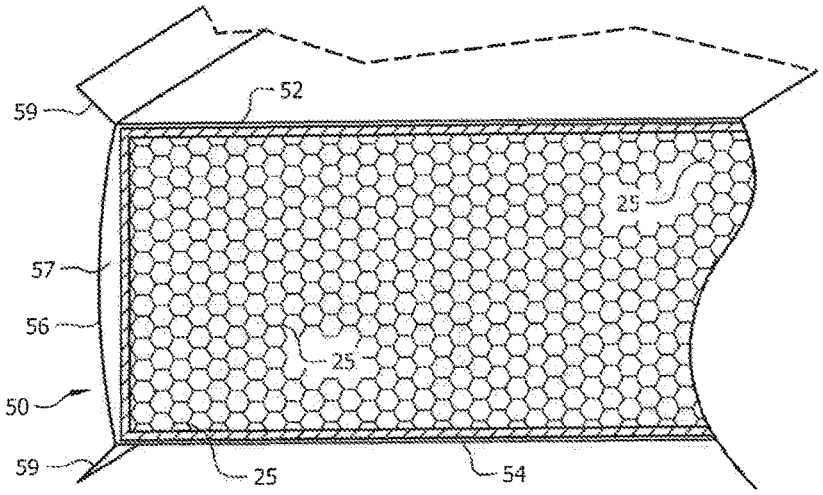
FIG. 2 illustrates a cross-sectional view of an exemplary embodiment of a mattress component.

In some embodiments, the bottom surface 54 may also be fused (for example welded) to the foam cores (for example, the corresponding, lower surface of the foam cores). And while some embodiments may likewise fuse the side surfaces 56 to the foam cores, in the embodiment of FIG. 1 the side surfaces 56 typically would not be fused to the foam cores (leaving a gap of air between one or more side surfaces of the impermeable cover and the corresponding surfaces of the foam cores). FIG. 2 better illustrates the air space 57 between the side surface 56 of the impermeable cover 50 and the corresponding outer surface of the foam core 25. So in the embodiment of FIG. 2, the top and bottom surfaces 52, 54 of the impermeable cover may be fused or otherwise bonded (for example using adhesive) to the corresponding surfaces of the foam cores 25, while the side surfaces 56 of the impermeable cover may not be fused or bonded to the corresponding surfaces of the foam core 25 (leaving an air space 57 on one or more side surfaces of the mattress of FIG. 2). The air spaces 57 located on the sides of the mattress of FIG. 2 may aid in distributing air within the open cell foam cores more quickly and/or efficiently. FIG. 2 also shows the seals 59 between adjacent (mating) surfaces of the impermeable cover 50. The seals 59 typically may be formed by welding (or otherwise attaching) of the material of the top surface 52 to overlapping portions of the adjacent side surface 56 and/or welding the material to the bottom surface 54 to the overlapping portions of the adjacent side surface 56, for example. Further, the side surfaces may be welded to adjacent mating side surfaces. So in FIG. 2, the impermeable cover 50 may form a box-like enclosure with seals 59 typically extending from the corners and/or edges.

Figure 3:
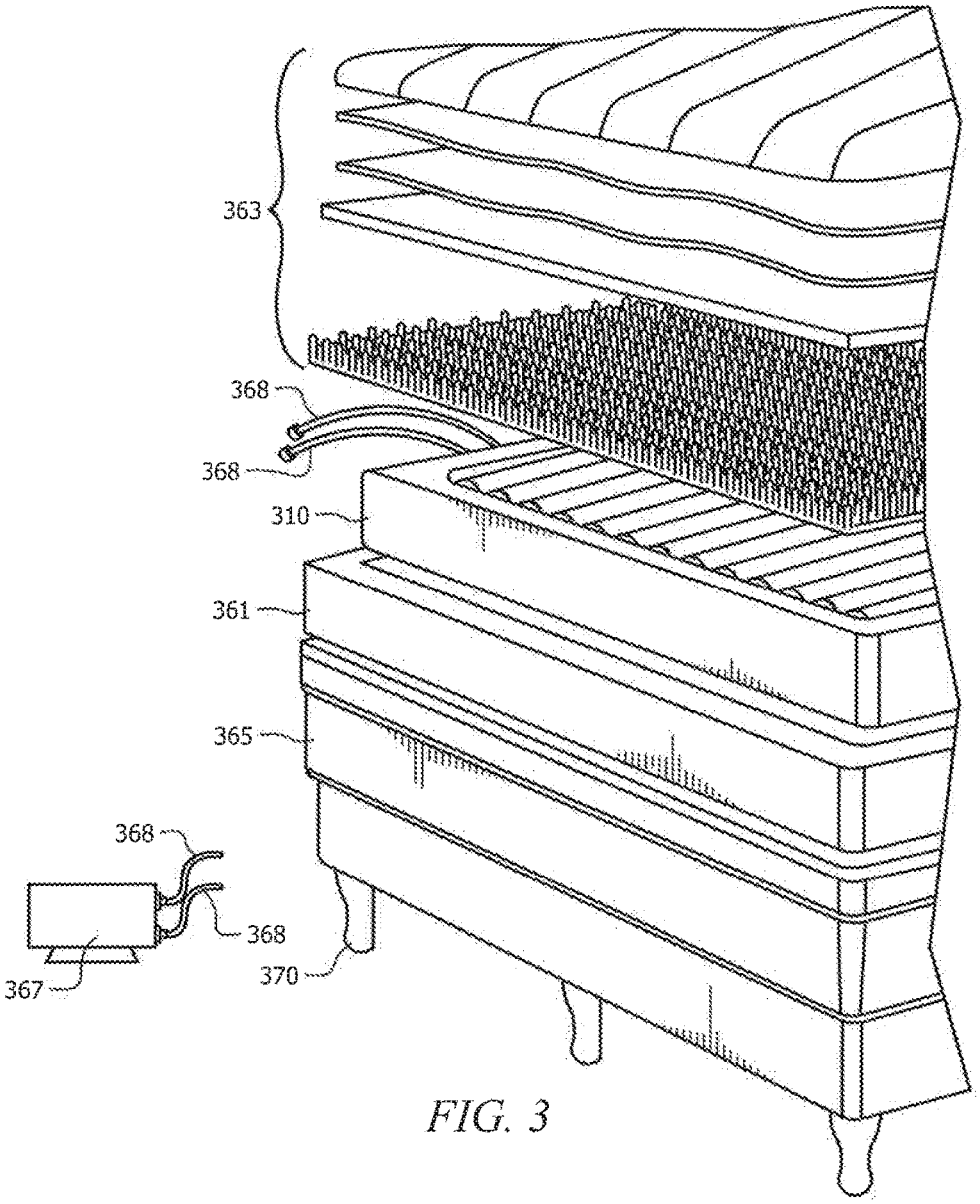
FIG. 3 illustrates an exploded perspective view of an exemplary embodiment of a bed having a mattress with an exemplary mattress component.

FIG. 3 illustrates an exemplary bed having a mattress with foam-filled air chamber(s). The foam-air mattress component 310 (typically having one or more foam cores within an air impermeable cover, forming one or more foam-filled air chamber) typically may be in fluid communication with one or more pumps 367 (for example via one or more hoses 368), allowing for adjustment of the support/comfort (for example the IFD) of the air chamber(s) based on user preference. The foam-air mattress component 310 of FIG. 3 may be surrounded on its external side perimeters by a foam encasement railing 361 (which typically may be formed of firmer foam than that used within the air chambers). The foam encasement may help reduce collapse of a side edge, for example when a user is sitting on the edge of the bed and/or when the air pressure in the air chamber is low). And in FIG. 3, one or more comfort layers 363 may be placed atop the mattress component 310. Typically, in FIG. 3 the inner components (such as the foam-air mattress component 310, the foam encasement railing 361 and/or the comfort layers 363) may be enclosed within an outer casing (for example a ticking material to keep the components together and integrated into a single whole mattress and/or to protect the inner components). The mattress may be placed atop a bed frame 370 for use. Persons of skill should understand that one or more of the internal components might be optional and/or optionally located within the impermeable cover of the mattress component 310. For example, in some embodiment, one or more comfort layers might be located within the air impermeable cover. In other embodiments, the foam encasement might be located within the impermeable cover (essentially providing firmer foam about the inner perimeter of the impermeable cover with softer foam located inward toward the center of the air chamber).

Figure 4:
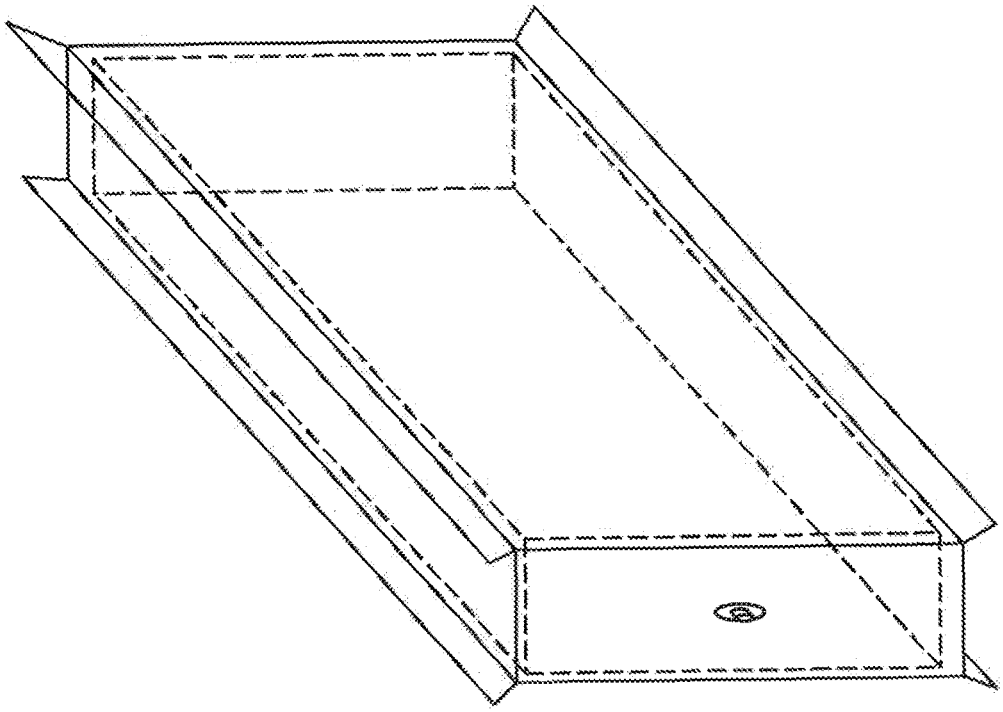
FIG. 4. illustrates a perspective view of an exemplary embodiment of a mattress, having only one foam-filled air chamber.

FIG. 4 illustrates a mattress comprising only a single foam-filled air chamber within the impermeable cover (with only a single foam core, for example, and with no divider panel). Such a design might be quite similar to that of FIG. 1, but might be used for smaller beds (for example a twin and/or full sized mattress) that may not require individual control of the firmness of different sides of the mattress. Nevertheless, the mattress of FIG. 4 may include a foam core forming a foam-filled air chamber within the air impermeable cover. And in embodiments, the top and/or bottom surface of the impermeable cover may be fused to the foam core. Typically, a pump (not shown) might be in fluid communication with the interior of the air chamber via an air inlet valve, and the pump might be used to control the IFD characteristics of the air chamber (for example, in a manner similar to that used for Sleep Number Beds™).

Figure 5:
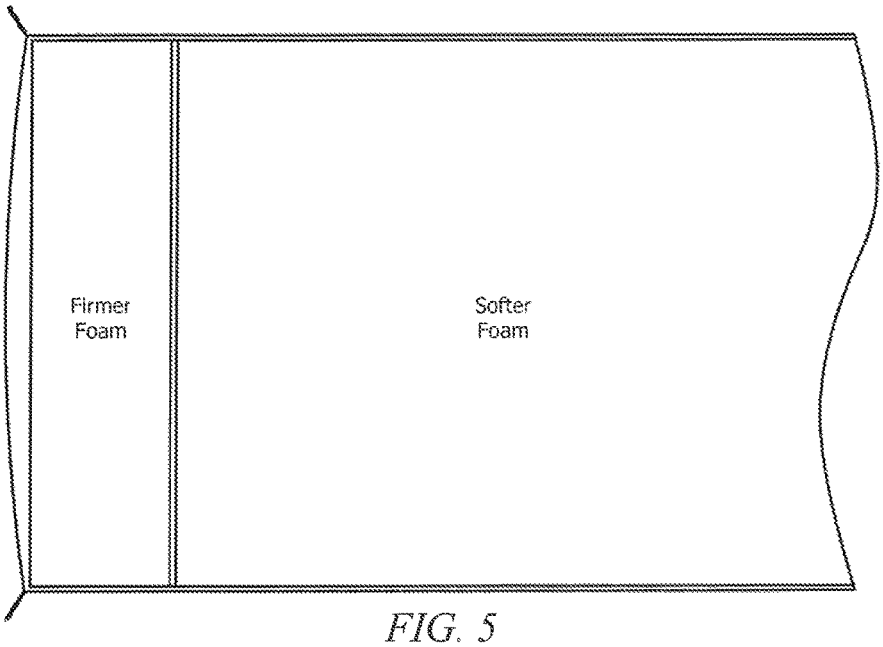
FIG. 5 illustrates a cross-sectional view of an exemplary embodiment of a mattress having foam encasement (of firmer foam, for example) located within the impermeable cover.

As briefly discussed above with respect to FIG. 3, the foam encasement railing (having firmer foam) may be located within the impermeable cover of the mattress in some embodiments (rather than being located externally about the perimeter of the impermeable cover of the mattress component). FIG. 5 illustrates (with a partial cross-section) such an arrangement, in which firmer foam may be located about the inner perimeter of the impermeable cover (about the soft foam core of the air chamber). In other words, the foam core of FIG. 5 may be formed of more than one foam material, with the outer perimeter of the foam core being formed of firmer foam while the inner foam is softer. The firmer perimeter foam may help to reduce edge collapse (and/or bottoming out), especially when the air pressure in the air chamber may be low and/or the air may be displaced from the side, for example). While the different foam elements of the foam core (of FIG. 5, for example) might be placed in position within the impermeable cover (i.e. without being joined, but merely held in place by the impermeable cover), in the embodiment of FIG. 5 the foam elements typically might be bonded together into an integral whole (so that the foam core acts as a single unit).

Figure 6A:
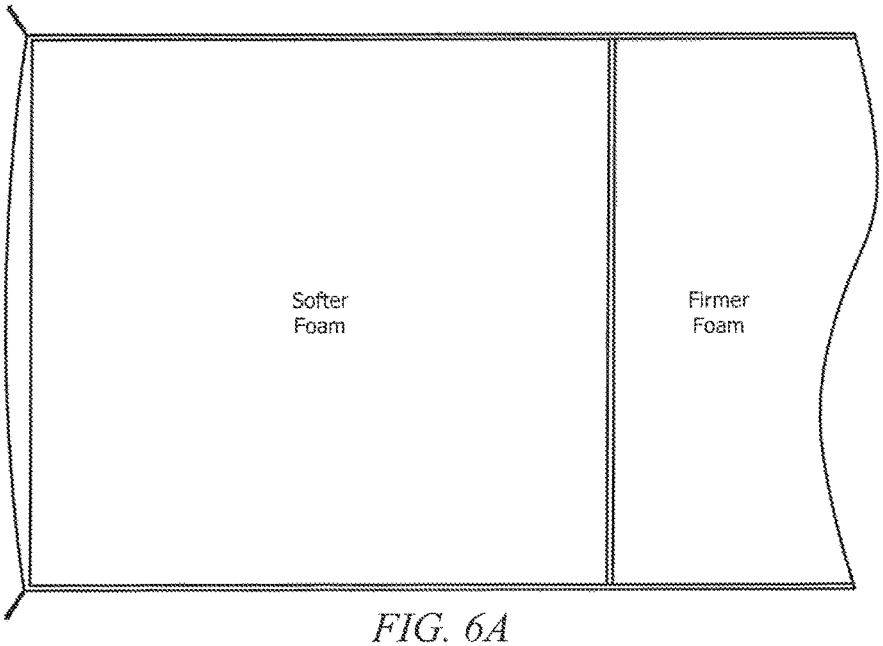
FIG. 6A illustrates a cross-sectional view of different foam elements within the foam core of an exemplary mattress, for example for posturization.
Figure 6B:
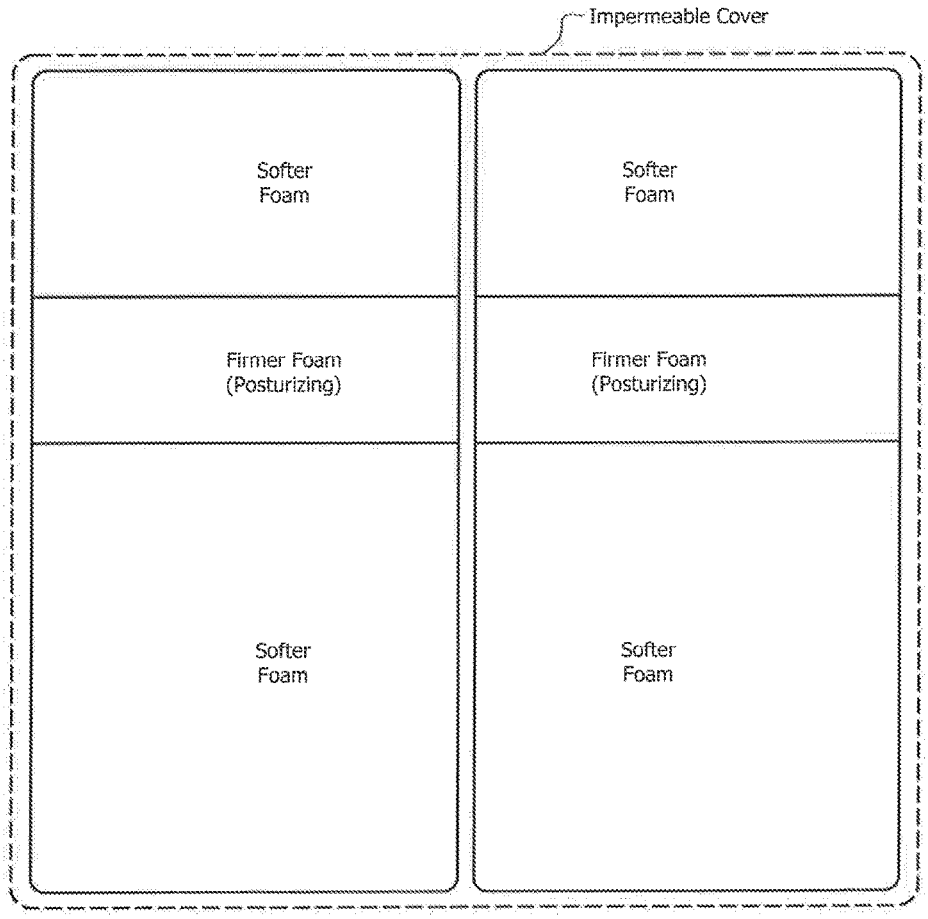
FIG. 6B illustrates a plan view of the top of exemplary foam cores with posturizing foam, having firmer foam for support of a user's hips and/or lower back, for example.
Figure 7A:
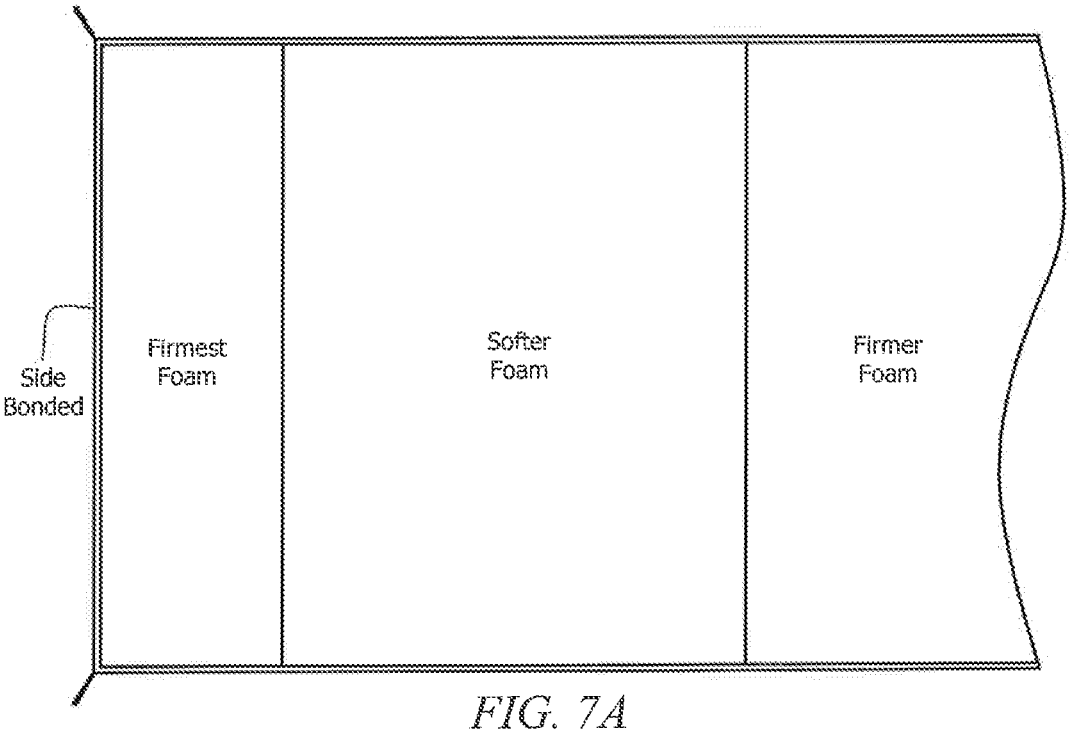
FIG. 7A illustrates a cross-sectional view of an exemplary embodiment of a mattress having different foam elements with the foam core, for example a firmer side encasement and a firmer posturizing foam within a generally softer foam core.
Figure 7B:
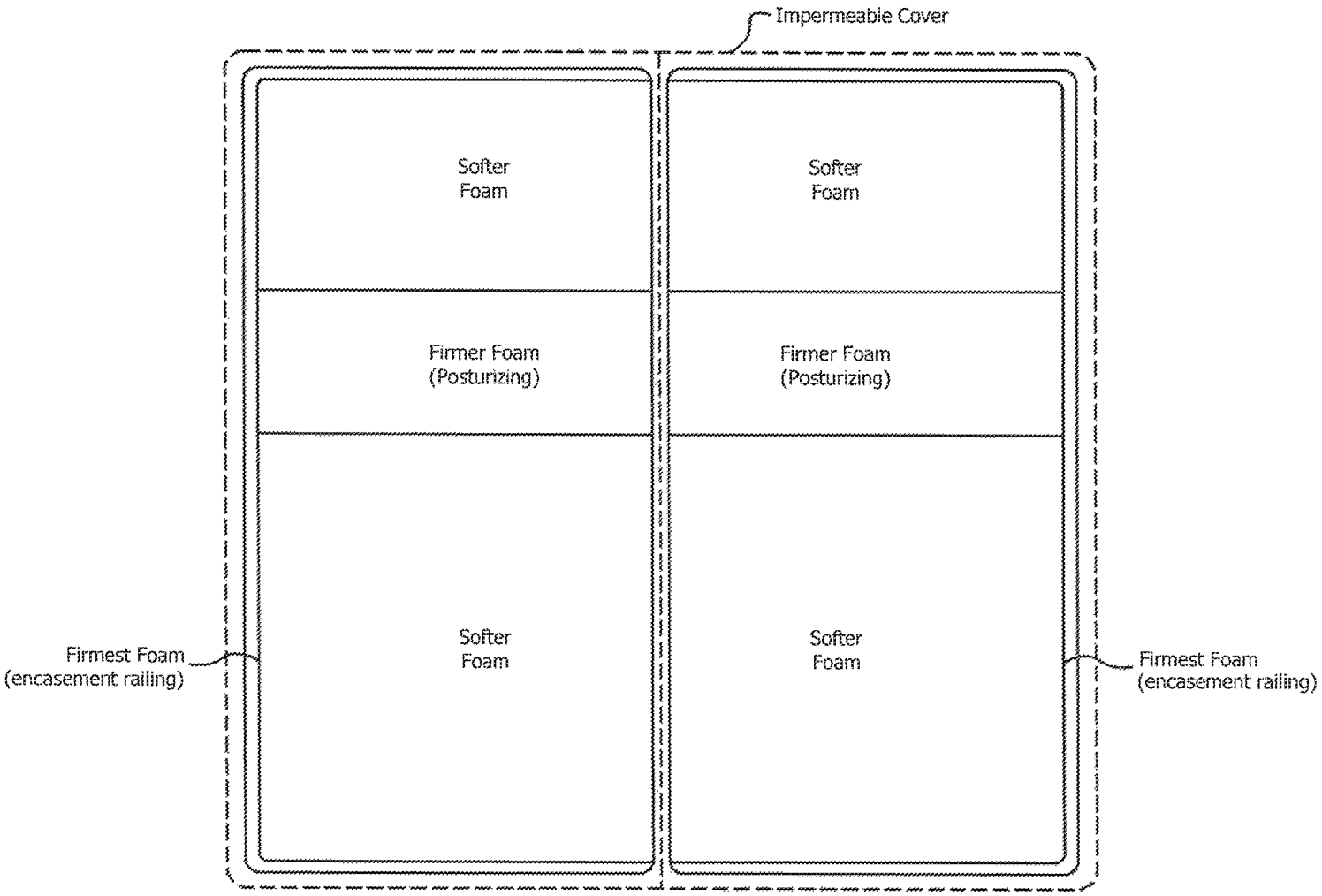
FIG. 7B illustrates a plan view of the top of exemplary foam cores with firmer posturizing foam and side encasement railing.

FIGS. 6A and 6B show embodiments in which firmer posturizing foam may be located within the foam core to help support the user's hips and/or lower back, for example. FIGS. 7A and 7B show embodiments which may combine the features of FIG. 5 and FIG. 6B, for example. So in FIG. 7B, for instance, the foam cores may each comprise a firmer foam border or perimeter (for example, an internal encasement foam railing) about the perimeter of the foam core (but not, for example, typically along the inner border of the air chambers), and may also comprise firmer posturizing foam toward the center of the length of the mattress. The remainder of the foam core typically would be a softer foam, for example of the type discussed above. While the firmness of the foam of the encasement railing and the posturizing foam may be the same or different (so long as they both typically may be firmer than the softer foam), in the embodiment of FIG. 7B the encasement railing may be the firmest foam, while the posturizing foam may have an intermediate firmness between that of the encasement railing and the softer foam. Persons of skill should understand that the foam core(s) of embodiments may be formed of one or more foams, which typically might be integrated into a whole foam core (either by adhesive or other such attachment means or by placement and enclosure within the impermeable cover, for example).

Several of the underlying concepts disclosed above may be related to the disclosure regarding pillows and other cushioned support devices as set forth in pending, co-owned U.S. patent application Ser. No. 13/553,276, filed Jul. 19, 2012 and entitled "Comfort Customizable Pillow", which is fully incorporated by reference herein as supplemental (for example, background) material to the extent it does not conflict or contradict the explicit disclosure herein. Persons of skill should understand various embodiments, which may include a combination of the disclosure herein and the disclosure incorporated by reference. Inventive scope should be read broadly, with the scope of protection not being limited to specific descriptions of disclosed embodiments but, rather, being established by the claims.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled, affixed, attached, or communicating with each other may be indirectly coupled, affixed, attached, or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A mattress comprising:

two open cell foam cores;

an air impermeable cover encasing both foam cores and having an air impermeable divider extending lengthwise from a head of the mattress to a foot of the mattress between the two foam cores forming two joined side-by-side foam-filled air chambers, with each air chamber extending from the head to the foot of the mattress; and an air inlet valve for each air chamber;

wherein each of the foam cores has an IFD;

wherein each air chamber has an adjustable IFD range, with a minimum air chamber IFD and a maximum air chamber IFD;

wherein the minimum IFD of the air chamber range is greater than the IFD provided by self-inflation of the air chambers by the foam cores;

wherein the foam core is incapable of self-inflating the air chamber to the minimum IFD of the air chamber range, such that the minimum IFD of the air chamber range requires additional air above self-inflation of the air chambers by the foam cores;

wherein each foam core is formed of the same type of foam; and wherein the mattress is sized as a full, queen, or king.

2. The mattress of claim 1, wherein the impermeable cover further comprises a top surface and a bottom surface; and wherein the top surface and bottom surface of the impermeable cover are each fused to a corresponding surface for the two foam cores.

3. The mattress of claim 2, wherein the impermeable cover further comprises a plurality of side surfaces; and wherein the side surfaces are not fused to corresponding surfaces for the two foam cores, creating an air space on each side of the mattress between the impermeable cover and the foam cores.

4. The mattress of claim 1, wherein the foam of the foam cores has an IFD sufficiently low so as to not provide sufficient support for sleep without additional air being added via pump in the air chambers above ambient atmospheric pressure.

5. The mattress of claim 1, wherein the foam cores each comprise urethane foam.

6. The mattress of claim 5, wherein the impermeable cover comprises woven polyester.

7. The mattress of claim 1, wherein the impermeable cover has improved elasticity.

8. The mattress of claim 1, wherein each foam core comprises at least two different foam elements having different characteristics; wherein one of the at least two different foam elements is firmer posturizing foam extending laterally substantially across the width of the air chamber; and wherein the at least two different foam elements are positioned with respect to each other longitudinally within the air chamber.

9. The mattress of claim 1, further comprising one or more comfort layers atop the air chambers; an outer casing encasing the air chambers and comfort layers; and two pumps, each in fluid communication with corresponding air inlet valves for the two air chambers and configured to pressurize the air chambers above atmospheric pressure to provide additional air above that provided by self-inflation to reach the minimum IFD of the air chamber and to adjust IFD for the air chamber between the minimum and maximum air chamber IFD based on user preference.

10. The mattress of claim 3, wherein the impermeable cover is formed by welding the top surface to the plurality of side surfaces; the bottom surface to the plurality of side surfaces; and each side surface to adjacent side surfaces; thereby forming seals at welding interfaces.

11. The mattress of claim 1, wherein the IFD of each air chamber of the mattress is adjusted based on an added amount of air pressure within each air chamber above ambient external atmospheric conditions; and wherein the type of foam for the foam cores has an IFD of 20 or less.

12. A mattress comprising:

an open-cell foam core; and an impermeable cover enclosing the foam core;

wherein the impermeable cover comprises an air inlet valve and a top surface; and wherein the top surface of the impermeable cover is fused to a corresponding surface of the foam core; and wherein the foam core has an IFD, and the IFD of the foam core is insufficient to self-inflate the mattress to a minimum mattress IFD to provide sufficient support for sleep.

13. The mattress of claim 12, wherein the impermeable cover comprises a plurality of side surfaces, and wherein the side surfaces are not fused to the foam core.

14. The mattress of claim 12, wherein the foam core has an IFD of 20 or less.

15. The mattress of claim 14, wherein the foam core comprises urethane foam; wherein the impermeable cover comprises woven polyester, and wherein the impermeable cover comprises a material operable to be fused to the urethane foam.

16. The mattress of claim 12, wherein the foam core extends lengthwise from a head of the mattress to a foot of the mattress.

17. The mattress of claim 12, further comprising a pump in fluid communication with the air inlet valve and operable to adjust mattress firmness above the foam core IFD to at least the minimum mattress IFD via additional air pressurization of the mattress above atmospheric pressure.

18. A mattress comprising:

an open-celled foam core; and an impermeable cover enclosing the foam core;

wherein the impermeable cover comprises a means of fluid communication with an external pump, and a top surface; and wherein the top surface of the impermeable cover is joined to at least a portion of a corresponding surface of the foam core;

wherein the foam core has an IFD;

wherein the mattress has an adjustable IFD range, with a minimum mattress IFD and a maximum mattress IFD;

wherein the maximum IFD of the mattress range is greater than the IFD of the foam core, such that the foam core is incapable of self-inflating the mattress to the maximum IFD of the mattress range; and wherein the foam core extends lengthwise from a head of the mattress to a foot of the mattress.

19. The mattress of claim 18, wherein the enclosure of the foam core within the impermeable cover forms a foam-filled air chamber, with the IFD of the air chamber being adjustable to user preference based on the amount of air added by the external pump above self-inflation pressure within the air chamber.

20. The mattress of claim 19, wherein the IFD of the foam core is less than the minimum limit of the IFD range of the mattress air chamber, such that the foam-filled air chamber is not self-inflating to a level for serving as an effective sleep support for a person; and wherein the foam core has an IFD of 20 or less.

21. The mattress of claim 1, wherein IFD for one of the air chambers is operable to be adjusted in a range from the minimum air chamber IFD to the maximum air chamber IFD by a user lying atop the air chamber.

22. The mattress of claim 9, wherein each pump is operable to adjust IFD of the corresponding air chamber by set increments.

* * * * *